US005431139A

United States Patent [19]

Grutter et al.

[11] Patent Number: 5,431,139

[45] Date of Patent: Jul. 11, 1995

[54] AIR INDUCTION CONTROL SYSTEM FOR VARIABLE DISPLACEMENT INTERNAL COMBUSTION ENGINE

[75] Inventors: Peter J. Grutter, Plymouth; Daniel J. Lipinski, Livonia; Julian A. LoRusso, Grosse Ile; Donald R. Nowland, Taylor; Ernest C. Prior, Woodhaven; Jerry D. Robichaux, Southgate, all of Mich.

[73] Assignee: Ford Motor Company, Dearborn, Mich.

[21] Appl. No.: 172,349

[22] Filed: Dec. 23, 1993

[51] Int. Cl.[6] ..... F02B 77/00

[52] U.S. Cl. ..... 123/198 F; 123/399

[58] Field of Search ..... 123/399, 403, 198 F, 123/481

[56] References Cited

U.S. PATENT DOCUMENTS

| | | | |
|---|---|---|---|
| 4,040,395 | 8/1977 | Demetrescu | 123/198 F |
| 4,144,864 | 3/1979 | Kato et al. | 123/198 F |
| 4,188,933 | 2/1980 | Iizuka | 123/198 F |
| 4,224,920 | 9/1980 | Sugasawa et al. | 123/198 F |
| 4,354,471 | 10/1982 | Sugasawa et al. | 123/198 F |
| 4,484,551 | 11/1984 | Choma et al. | 123/336 |
| 4,494,502 | 1/1985 | Endo et al. | 123/198 F |
| 4,509,488 | 4/1985 | Forster et al. | 123/198 F |
| 4,541,387 | 9/1985 | Morikawa | 123/198 F |
| 4,550,704 | 11/1985 | Barho et al. | 123/198 F |
| 4,552,114 | 11/1985 | Sano et al. | 123/198 F |
| 4,556,026 | 12/1985 | Masuda et al. | 123/198 F |
| 4,655,187 | 4/1987 | Gravestock | 123/198 F |
| 4,708,108 | 11/1987 | Sakamoto et al. | 123/339 |
| 4,722,411 | 2/1988 | Ohashi et al. | 123/336 |
| 4,760,825 | 8/1988 | Morita | 123/399 |
| 4,870,934 | 10/1989 | Vanetta et al. | 123/336 |
| 4,962,740 | 10/1990 | Fujimoto et al. | 123/481 |
| 4,976,228 | 12/1990 | Kawamura | 123/198 F |
| 5,035,220 | 7/1991 | Uchinami et al. | 123/481 |
| 5,042,444 | 8/1991 | Hayes et al. | 123/198 F |
| 5,099,816 | 3/1992 | Ohga | 123/198 F |
| 5,113,823 | 5/1992 | Iriyama | 123/399 |
| 5,119,781 | 6/1992 | Trombley et al. | 123/481 |
| 5,124,922 | 6/1992 | Akiyama | 123/336 |
| 5,190,013 | 3/1993 | Dozier | 123/198 F |
| 5,213,081 | 5/1993 | Fujimoto | 123/481 |
| 5,267,541 | 12/1993 | Taguchi et al. | 123/198 F |

OTHER PUBLICATIONS

"4,6,8 . . . Which Cylinder Shall We Operate?", *Motor*, Jun 25, 1983, pp. 52–53.

D. Stojek and D. Bottomley, "The Ford 3×6 Engine", Proceedings IMech vol. 198D, No. 15.

G. Berta, M. Troilo, "Cylinder Shut-off and Pressure Charging for Lower Fuel Consumption", SAE 82072.

K. Schellman and W. Schmidt, "Possibilities by Saving Fuel by Switching Off Cylinders", Fuel Economy Research Conference, Unknown data & location.

T. Fukui, T. Nakagami, H. Endo, T. Katsumoto and Y. Danno, "Mitsubishi Orion-MD, A New Variable Displacement Engine," SAE 831007.

B. Bates, J. Dosdall and D. Smith, "Variable Displacement by Engine Valve Control", SAE Paper 780145, 1978.

"Mitsubishi has variable 2 or 4-cylinder engine", Wards Engine and Vehicle Technology Update, Sep. 1, 1992.

"Mitsubishi unveils new fuel savings engine", recent article in Automative News, Aug.-Sep. 1992.

*Primary Examiner*—Noah P. Kamen

*Attorney, Agent, or Firm*—Jerome R. Drouillard; Roger L. May

[57] ABSTRACT

A system for controlling the flow of air entering the intake manifold of a multicylinder variable displacement internal combustion engine installed in a vehicle having a driver-operable accelerator control includes an accelerator control position sensor for determining the operating position of the accelerator control and for generating an accelerator control position signal indicating such position, as well as an engine speed sensor for determining the speed of the engine and for generating an engine speed signal indicating such speed. The present system further includes an engine cylinder operator for deactivating and reactivating at least some of the cylinders and an electronically controlled throttle valve positioned in the intake manifold of the engine so as to control the amount of air entering the engine's cylinders. A processor connected with the cylinder operator and with the throttle valve receives the accelerator control position signal and the engine speed signal and selects an operating position for the throttle valve, based on the values of the accelerator control position signal and the engine speed signal, as well as upon the effective displacement of the engine.

16 Claims, 2 Drawing Sheets

AIR INDUCTION CONTROL SYSTEM FOR VARIABLE DISPLACEMENT INTERNAL COMBUSTION ENGINE

BACKGROUND OF THE INVENTION

This invention relates to a system for operating an electronic air throttle for a multi-cylinder variable displacement internal combustion engine installed in a vehicle having a driver operable accelerator control.

DESCRIPTION OF THE PRIOR ART

Automotive vehicle designers and manufacturers have realized for years that it is possible to obtain increased fuel efficiency if an engine can be operated on less than the full complement of cylinders during certain running conditions. Accordingly, at low speed, low load operation, it is possible to save fuel if the engine can be run on four instead of eight cylinders or three, instead of six cylinders. In fact, one manufacturer offered a 4-6-8 variable displacement engine several years ago, and Ford Motor Company designed a 6-cylinder engine capable of operation on only three cylinders which, although never released for production, was developed to a highly refined state. Unfortunately, both of the aforementioned engines suffered from deficiencies associated with their control strategies. Specifically, customer acceptance of the engine system actually in production was unsatisfactory because the powertrain tended to "hunt" or shift frequently between the various cylinder operating modes. In other words, the engine would shift from 4 to 8 cylinder operation frequently, while producing noticeable torque excursions. This had the undesirable effect of causing the driver to perceive excessive changes in transmission gear in the nature of downshifting or upshifting. Another drawback to prior art systems resided in the fact that the engine's torque response corresponding to a given change in the accelerator pedal position varied quite widely with the number of cylinders actually in operation. For example, when the engine was in 8-cylinder operation, a given change in the accelerator pedal position would produce a certain change in engine torque output at any particular engine speed. However, when the engine was operated at less than the total number of cylinders, e.g., 4 or 6 cylinders, for the same change in accelerator pedal position a much reduced torque response was available. As a result, the vehicles felt sluggish and non-responsive to driver input.

It is an object of the present invention to provide a system for operating the engine's air throttle such that changes in the number of cylinders being operated to be transparent with respect to the driver's perceptions of the engine's throttle response.

It is another object of the present invention to provide a system for controlling the amount of air entering the engine's cylinders such that closed throttle operation of the mechanical throttle portion of the system will be marked by a flow of air sufficient to prevent unwanted drivetrain clunking and exhaust hydrocarbon emissions. This will also serve to avoid the engine stalling which could occur if an unlocked torque converter is used.

SUMMARY OF THE INVENTION

A system for controlling the flow of air entering the intake manifold of a multicylinder variable displacement internal combustion engine installed in a vehicle having a driver-operable accelerator control includes an accelerator control position sensor for determining the operating position of the accelerator control and for generating an accelerator control position signal indicating such position, as well as an engine speed sensor for determining the speed of the engine and for generating an engine speed signal indicating such speed. The present system further includes an engine cylinder operator means for deactivating and reactivating at least some of the cylinders and an electronically controlled throttle valve positioned in the intake manifold of the engine so as to control the amount of air entering the engine's cylinders. A processor connected with the cylinder operator means and with the throttle valve includes means for receiving the accelerator control position signal and the engine speed signal, and means for selecting an operating position for the throttle valve, based on the values of the accelerator control position signal and the engine speed signal, as well as upon the effective displacement of the engine. The processor utilizes a transfer function of accelerator control position, with the function including the instantaneous position of the accelerator control, as well as the time rate of change of the accelerator control. Airflow into the engine may be regulated either solely by the electronically controlled throttle valve, or by a mechanically controlled valve coupled to the accelerator control, with the two throttle valves being separated sufficiently so that fully developed flow is present at the electronic throttle. A system according to the present invention may further include means for selecting the operating gear for a transmission connected to the engine, such that the gear speed selection is based at least in part on the value of the accelerator position transfer function.

DETAILED DESCRIPTION OF THE PREFERRED EMBODIMENTS

Figure 1:
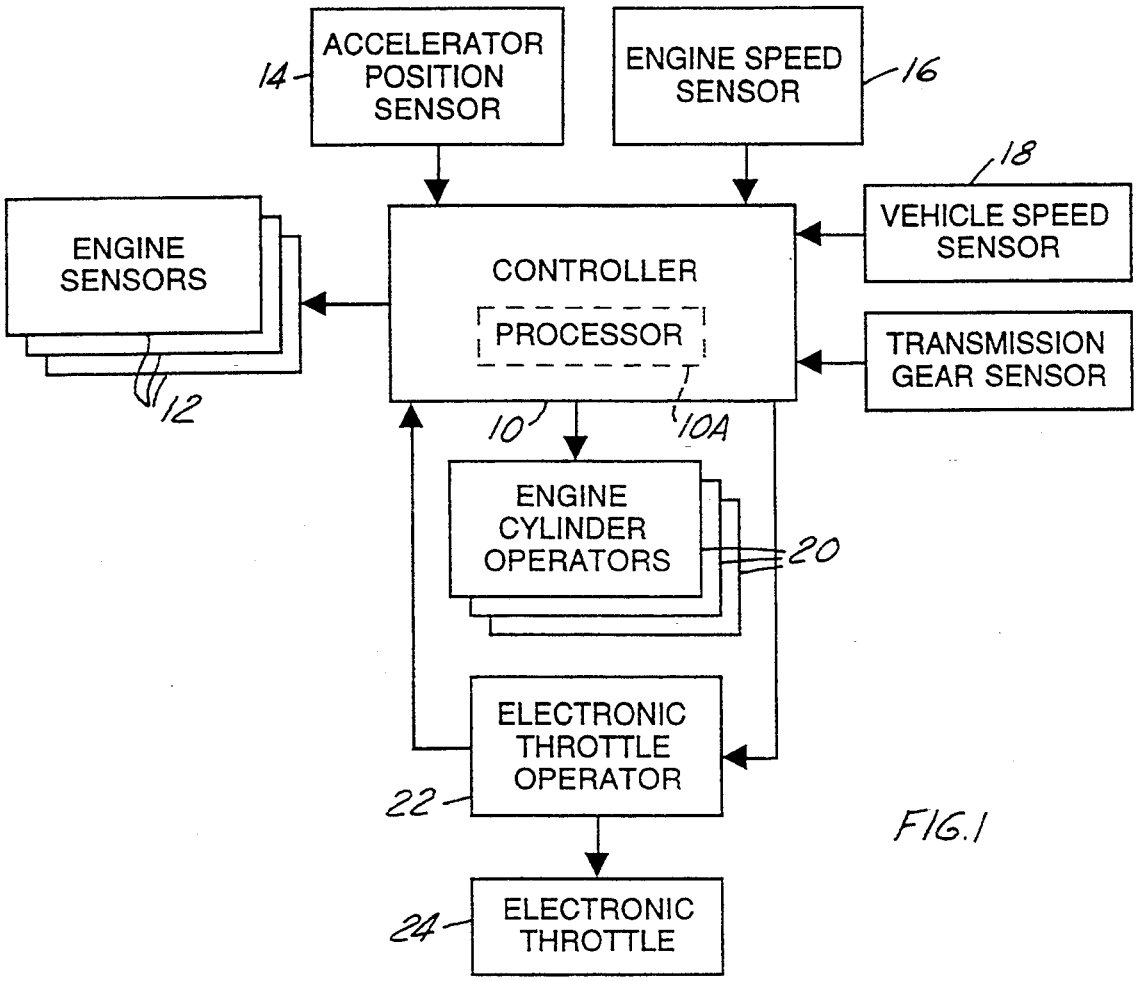
FIG. 1 is a block diagram of an air induction control system according to the present invention.

As shown in FIG. 1, an air induction control system for governing airflow into the intake manifold of a variable displacement automotive engine according to the present invention includes microprocessor controller 10 of the type commonly used to provide engine control. Controller 10 contains microprocessor 10A, which uses a variety of inputs from various sensors, such as sensors 12, which may include engine coolant temperature, air charge temperature, engine mass airflow, intake manifold pressure, and other sensors known to those skilled in the art and suggested by this disclosure. Controller 10 also receives information from accelerator pedal position sensor 14, engine speed sensor 16, and vehicle speed sensor 18. Controller 10 may operate spark timing control, air/fuel ratio control, exhaust gas recirculation ("EGR") control, and other engine functions. In addition, through a plurality of engine cylinder operators 20, controller 10 has the capability of disabling selected cylinders in the engine so as to cause the engine to be of a lower effective displacement. For example, with an 8-cylinder engine, the engine may be operated on 4, 5, 6 or 7 cylinders, or even 3 cylinders, as required. Those skilled in the art will appreciate in view of this disclosure that a number of different disabling devices are available for selectively rendering the cylinders of the engine inoperative. Such devices include mechanisms for preventing any of the valves from opening in the disabled cylinders, such that gas remains trapped within the cylinder.

Controller 10 operates electronic throttle operator 22, which may comprise a torque motor, stepper motor or other type of device used for the purpose of positioning electronic throttle 24. An electronic throttle is, as its name implies, wholly apart from mechanically operated throttle 36, which is usually employed in connection with the manually operatable accelerator pedal 30 having pedal position sensor 14 attached thereto. Electronic throttle operator 22 provides feedback to controller 10 of the position of electronic throttle 24. A system according to the present invention could be employed with an engine having a mechanical throttle before or after an electronic throttle. Alternatively, the present system could be used with an engine having no mechanically actuated throttle.

Figure 2:
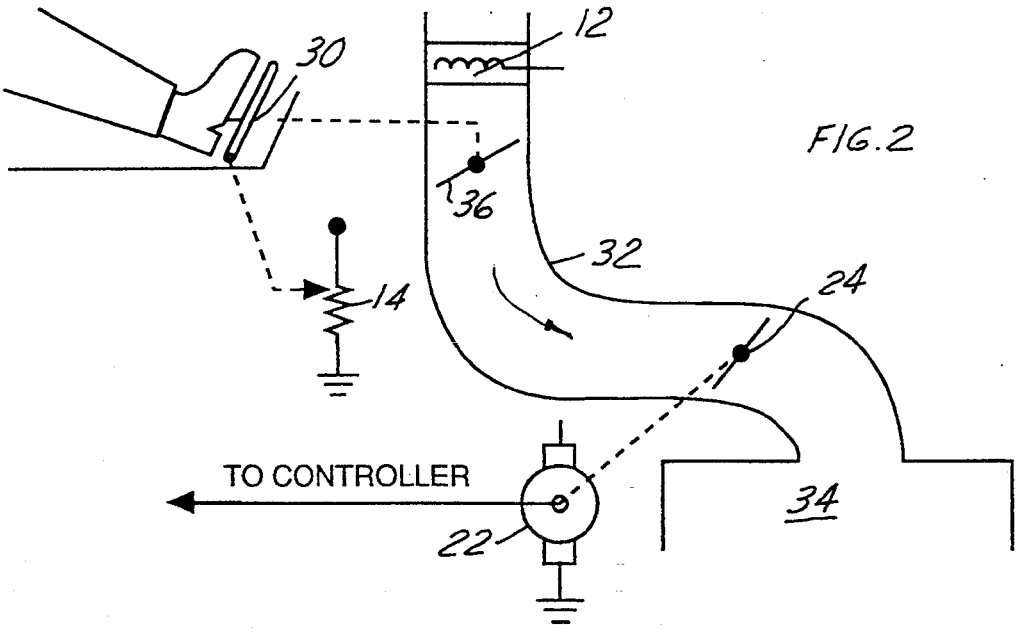
FIG. 2 is a schematic representation of the accelerator control and electronic throttle control portions of a system according to the present invention.

As shown in FIG. 2, air entering intake passage 32 first passes mechanically controlled throttle valve 36 prior to passing electronically controlled throttle valve 24. The flowing air also passes airflow sensor 12 prior to entering intake manifold 34. A system according to the present invention may be combined with a fuel injection control system operated not only according to the mass airflow method, but also with systems operated according to the speed density method, or a combination of both types of system.

Mechanical throttle valve 36 is positioned by the driver of the vehicle by means of accelerator pedal 30. If desired, mechanically controlled throttle 36 may be eliminated, inasmuch as electronically controlled throttle 24 may be provided with sufficient authority to operate the engine airflow control function without the assistance of mechanical throttle 36. Even if mechanical throttle 36 is eliminated, however, pedal position sensor 14 will be retained because this sensor provides the most reliable indication of driver demand.

In the event that a mechanical throttle is included in a system according to the present invention for redundancy or other reasons, it is desirable that the mechanical throttle open in an aggressive manner, such that the airflow is fully developed by the time it reaches the electronic throttle. In a system constructed according to the present invention for use with a 4.6 L 8-cylinder engine, a mechanical throttle having an 80 mm diameter was combined with an electronic throttle having a 65 mm diameter. The separation between the two throttle plates was set at 250–300 mm to ensure that the airflow was fully developed by the time it reached electronic throttle 24.

Figure 3:
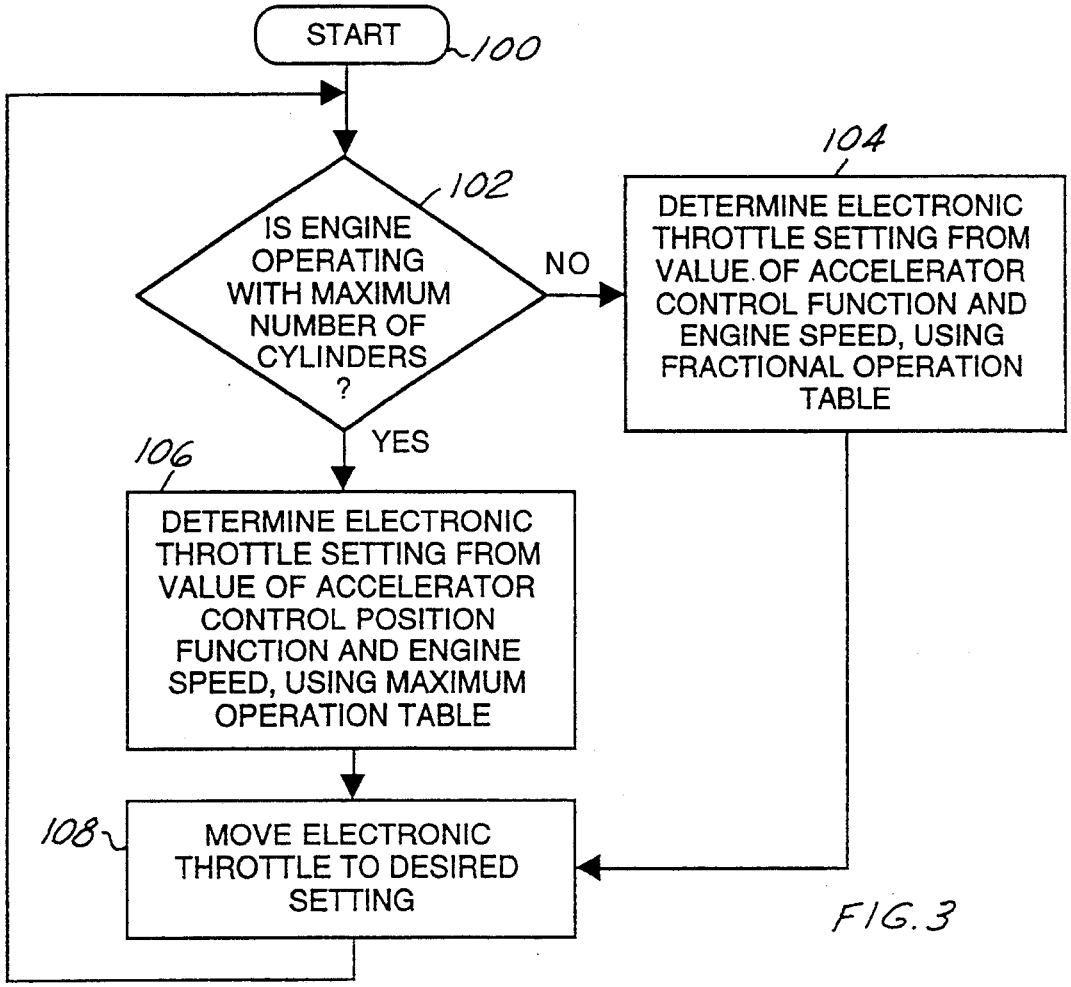
FIG. 3 is a flow chart illustrating the operation of a system according to the present invention.

Turning now to FIG. 3, the air induction control program begins at block 100 with the initiation of the program. At block 102, controller 10, acting through processor 10A, inquires as to whether the engine is operating with the maximum number of cylinders. In general, it may not be desirable to have less than the maximum number of cylinders operating at idle and at the highest speed range. Operation at less than the total number of cylinders at idle may be undesirable because of noise, vibration and harshness considerations. At high speeds, operation with fewer than the total number of cylinders may simply not produce enough power to drive the vehicle in a noise and vibration-free mode. Controller 10 operates the engine at acceptable levels of noise and vibration, while using the minimum number of cylinders. Operation with less than the total number of cylinders is termed "fractional" operation in this specification. For example, operation of an 8-cylinder engine on only 4 cylinders is fractional operation.

Figure 5:
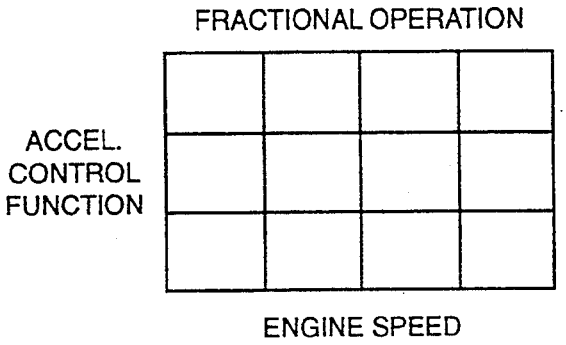
FIGS. 4 and 5 are schematic representations of lookup tables incorporated in one embodiment of the present system.
Figure 4:
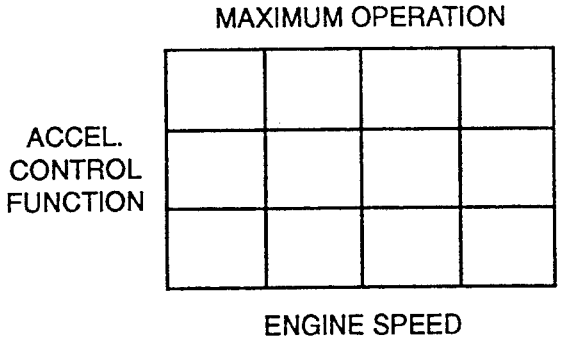

If the engine is in fractional operation at block 102, controller 10 proceeds to block 104, wherein the setting for electronic throttle 24 is determined from the value of an accelerator control function and from the speed of the engine, utilizing a lookup table designated for fractional operation. Such a table is shown in FIG. 5. For each tabular combination of engine speed and accelerator control function, a value is listed for the position of electronic throttle 24. This value is used by controller 10 and electronic throttle operator 22 to position electronic throttle 24 at block 108. Thereafter, the routine continues with block 102. At block 102, if the answer to the question is in the affirmative, i.e., the engine is operating with the maximum number of cylinders, the program moves to block 106, wherein the proper electronic throttle setting is once again determined from the values of the accelerator control function and engine speed, but with a different lookup table. This table, shown in FIG. 4, is for operation of the engine with the maximum number of cylinders. Once again, the routine moves to block 108, wherein electronic throttle 24 is moved to the desired position.

In general, for the driver of the vehicle to obtain equivalent throttle response when the engine is operating with four cylinders as when the engine is operating with eight cylinders, it is necessary that electronic throttle 24 be moved more aggressively when in the four cylinder mode.

The accelerator control function used by controller 10 to enter the electronic throttle position lookup tables shown in FIGS. 4 and 5 combines not only the instantaneous position of accelerator 30, but also the time rate of change, or velocity of the pedal or other accelerator control. Thus, when the driver pushes down aggressively on the pedal, the accelerator control function will have a different value than when the driver moves the pedal in a more leisurely fashion. In turn, the value of the electronic throttle control position drawn from the appropriate table as shown in FIGS. 4 and 5 will reflect the aggressive or more phlegmatic characteristics of the driver.

Another important use of the accelerator control position function relates to the control of automatic transmissions. Such transmissions have traditionally relied upon a reading of the throttle angle as a part of the strategy employed for determining the appropriate gear speed setting of the transmission. Unfortunately, with a variable displacement engine, the throttle setting no longer is a reliable indicator of the driver's wishes as to the degree of acceleration, for example, because a more aggressive throttle setting while in four cylinder operation may correspond to a much less aggressive setting while in eight cylinder operation. Nevertheless, this potential dilemma is solved according to another aspect of the present invention by providing that the value of the accelerator control position function, as opposed to the position of the throttle, will be used as an input for performing transmission gear selection. As noted above, accelerator pedal position, as well as the rapidity of change of position is a reliable indicator of the wishes of the driver, which may be used for more than one purpose.

With certain engines and induction systems, it has been determined that the response of a system according to the present invention may be enhanced if a correction factor, based upon the actual measured airflow through the engine, is applied to the value for the electronic throttle setting extracted from the appropriate lookup table. Also, the selection of a particular lookup table for use with the present system may be based upon vehicle speed. These and many other modifications and changes may be made to the system described herein without departing from the scope of the invention as set forth in the appended claims.

We claim:

1. A system for controlling the flow of air entering the intake manifold of a multicylinder variable displacement internal combustion engine installed in a vehicle having a manually operable accelerator control, said system comprising:

a position sensor for determining the operating position of the accelerator control and for generating an accelerator control position signal indicating such position;

an engine speed sensor for determining the speed of the engine and for generating an engine speed signal indicating such speed;

engine cylinder operator means for deactivating and reactivating at least some of said cylinders;

an electronically controlled throttle valve positioned in the intake manifold of the engine, so as to control the amount of air entering the engine cylinders; and a processor connected with said cylinder operator means and with said throttle valve, with said processor comprising:

means for receiving said pedal position and engine speed signals;

means for selecting an operating position for the throttle valve, based on the values of the accelerator control position and engine speed signals, as well as upon the effective displacement of the engine.

2. A system according to claim 1, wherein said processor utilizes a transfer function of accelerator control position, including instantaneous position and the time rate of change of pedal position.

3. A system according to claim 1, further comprising a servomotor coupled to said throttle valve, as well as to said processor, for positioning the throttle valve in response to commands from the processor.

4. A system according to claim 1, further comprising a mechanically controlled throttle valve coupled to said accelerator control, such that air entering the engine must pass not only said electronically controlled throttle valve, but also the mechanically controlled valve before entering the engine cylinders.

5. A system according to claim 4, wherein air entering the engine passes said mechanically controlled valve first and then said electronically controlled valve, with said valves being separated such that the air flow past the electronically controlled valve is fully developed.

6. A system according to claim 4, wherein said mechanically controlled throttle valve is operated such that the flow of air entering the engine cylinders is only minimally affected by the mechanically controlled valve once the speed of the engine exceeds an idle speed limit.

7. A system according to claim 1, further comprising means for operating a transmission connected with the engine such that the transmission gear is selected by said processor, based at least in part upon the value of the accelerator control position signal.

8. A system according to claim 1, wherein said processor selects the operating position of the throttle valve such that the changes in torque output of the engine which accompany changes in the position of the accelerator control remain substantially unaltered when the number of activated cylinders changes.

9. A system according to claim 1, wherein said processor selects the operating position of the throttle valve based not only upon the values of the accelerator control position and engine speed signals, but also upon a correction factor calculated from the measured airflow through the engine.

10. A system according to claim 1, wherein said processor selects the operating position of the throttle valve based not only upon the values of the accelerator control position and engine speed signals, but also upon the vehicle speed.

11. A system for controlling the airflow entering the intake manifold of a multicylinder variable displacement internal combustion engine installed in a vehicle having a manually controllable accelerator pedal, said system comprising:

a position sensor for determining the operating position of the accelerator pedal and for generating a pedal position signal indicating such position;

an engine speed sensor for determining the speed of the engine and for generating an engine speed signal indicating such speed;

engine cylinder operator means for deactivating and reactivating each of said cylinders;

an electronically controlled throttle valve positioned in the intake manifold of the engine, so as to control the amount of air entering the engine cylinders; and a processor connected with said cylinder operator means and with said throttle valve, with said processor comprising:

means for receiving said pedal position and engine speed signals;

means for selecting the number of cylinders to be operated and for commanding the cylinder operator means to activate the selected number of cylinders;

means for selecting an operating position for the throttle valve, based on the values of the engine speed signal as well as upon the value of a transfer function of the accelerator position signal, and upon the number of activated cylinders, such that the changes in the torque output of the engine which accompany changes in the position of the accelerator pedal remain substantially unaltered when the number of activated cylinders changes; and means for selecting the operating gear for a transmission connected with the engine, such that gear speed selection is based at least in part upon the value of the accelerator position signal transfer function.

12. A system according to claim 11, wherein said transfer function includes the instantaneous position and the time rate of change of position of said accelerator pedal.

13. A system for controlling the air entering the intake manifold of a multicylinder variable displacement internal combustion engine installed in a vehicle having a manually controllable accelerator pedal, said system comprising:

a position sensor for determining the operating position of the accelerator pedal and for generating a pedal position signal indicating such position;

an engine speed sensor for determining the speed of the engine and for generating an engine speed signal indicating such speed;

engine cylinder operator means for deactivating and reactivating each of said cylinders;

an electronically controlled throttle valve positioned in the intake manifold of the engine, so as to control the amount of air entering the engine cylinders; and a processor connected with said cylinder operator means and with said throttle valve, with said processor comprising:

means for receiving said pedal position and engine speed signals;

means for selecting the number of cylinders to be operated and for commanding the cylinder operator means to activate the selected number of cylinders; and means for selecting an operating position for the throttle valve, based on the values of the pedal position and engine speed signals, as well as upon the number of activated cylinders.

14. A system according to claim 13, wherein the operating position for the throttle valve is selected by the processor from a lookup table having at least a pedal position function and engine speed as independent variables.

15. A system according to claim 14, wherein said processor selects the operating position of the throttle valve such that the changes in torque output of the engine which accompany changes in the position of the accelerator pedal remain substantially unaltered when the number of activated cylinders changes.

16. A system according to claim 13, wherein said processor selects the operating position of the throttle valve based not only upon the values of the pedal position and engine speed signals, but also upon a correction factor calculated from the measured airflow through the engine.

* * * * *

US005431139C1

(12) EX PARTE REEXAMINATION CERTIFICATE (5737th)

United States Patent
Grutter et al.

(10) Number: US 5,431,139 C1
(45) Certificate Issued: Apr. 10, 2007

(54) AIR INDUCTION CONTROL SYSTEM FOR VARIABLE DISPLACEMENT INTERNAL COMBUSTION ENGINE

(75) Inventors: Peter J. Grutter, Plymouth, MI (US); Daniel J. Lipinski, Livonia, MI (US); Julian A. LoRusso, Grosse Ile, MI (US); Donald R. Nowland, Taylor, MI (US); Ernest C. Prior, Woodhaven, MI (US); Jerry D. Robichaux, Southgate, MI (US)

(73) Assignee: Ford Global Technologies, Inc., Dearborn, MI (US)

Reexamination Request:
No. 90/007,602, Jun. 23, 2005

Reexamination Certificate for:

| | |
|---|---|
| Patent No.: | **5,431,139** |
| Issued: | **Jul. 11, 1995** |
| Appl. No.: | **08/172,349** |
| Filed: | **Dec. 23, 1993** |

(51) Int. Cl.
*F02B 77/00* (2006.01)

(52) U.S. Cl. ..... 123/198 F; 123/399
(58) Field of Classification Search ..... None
See application file for complete search history.

(56) References Cited

U.S. PATENT DOCUMENTS 4,104,991 A * 8/1978 Abdoo ..... 123/198 F
5,113,823 A * 5/1992 Iriyama ..... 123/399

FOREIGN PATENT DOCUMENTS

JP H04-308335 10/1992

OTHER PUBLICATIONS

"How Mitsubishi Engine Works"—part of article "Mitsubishi unveils new fuel saving engine", recent article in Automotive News, Aug.–Sep. 1992.*

* cited by examiner

*Primary Examiner*—Bibhu Mohanty

(57) ABSTRACT

A system for controlling the flow of air entering the intake manifold of a multicylinder variable displacement internal combustion engine installed in a vehicle having a driver-operable accelerator control includes an accelerator control position sensor for determining the operating position of the accelerator control and for generating an accelerator control position signal indicating such position, as well as an engine speed sensor for determining the speed of the engine and for generating an engine speed signal indicating such speed. The present system further includes an engine cylinder operator for deactivating and reactivating at least some of the cylinders and an electronically controlled throttle valve positioned in the intake manifold of the engine so as to control the amount of air entering the engine's cylinders. A processor connected with the cylinder operator and with the throttle valve receives the accelerator control position signal and the engine speed signal and selects an operating position for the throttle valve, based on the values of the accelerator control position signal and the engine speed signal, as well as upon the effective displacement of the engine.

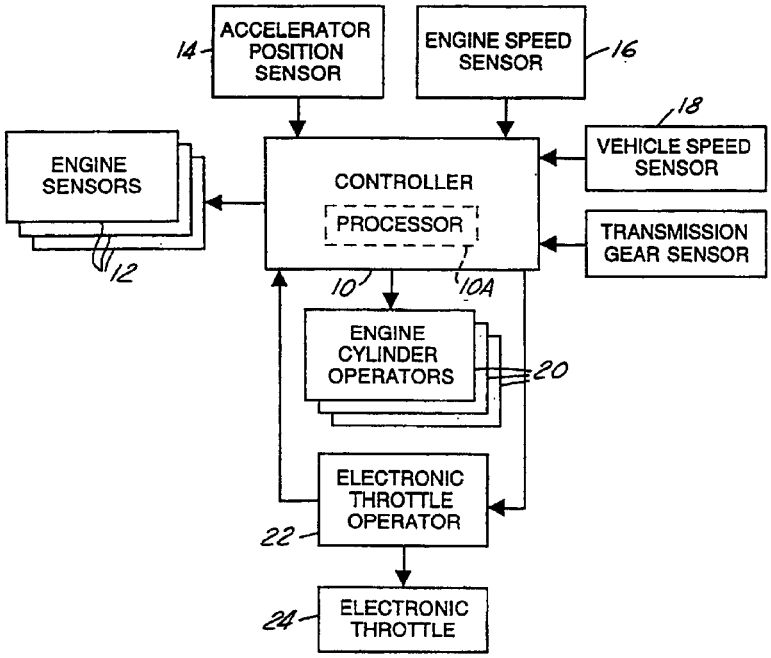

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 7 is cancelled.

Claims 1, 11 and 13 are determined to be patentable as amended.

Claims 2–6, 8–10, 12 and 14–16, dependent on an amended claim, are determined to be patentable.

New claims 17–21 are added and determined to be patentable.

1. A system for controlling the flow of air entering the intake manifold of a multicylinder variable displacement internal combustion engine installed in a vehicle having a manually operable accelerator control, said system comprising:

a position sensor for determining the operating position of the accelerator control and for generating an accelerator control position signal indicating such position;

an engine speed sensor for determining the speed of the engine and for generating an engine speed signal indicating such speed;

engine cylinder operator means for deactivating and reactivating at least some of said cylinders, *such engine cylinder operator means including one or more mechanisms configured to trap gas within deactivated cylinders, wherein all engine cylinders are activated responsive to high engine speeds*;

an electronically controlled throttle valve positioned in the intake manifold of the engine, so as to control the amount of air entering the engine cylinders; [and]

a processor connected with said cylinder operator means and with said throttle valve, with said processor comprising:

means for receiving said pedal position and engine speed signals;

means for selecting an operating position for the throttle valve, based on the values of the accelerator control position and engine speed signals, as well as upon the effective displacement of the engine*; and*

*means for operating a transmission connected with the engine such that a transmission gear is selected by said processor, based at least in part upon the value of the accelerator control position signal*.

11. A system for controlling the airflow entering the intake manifold of a multicylinder variable displacement internal combustion engine installed in a vehicle having a manually controllable accelerator pedal, said system comprising:

a position sensor for determining the operating position of the accelerator pedal and for generating a pedal position signal indicating such position;

an engine speed sensor for determining the speed of the engine and for generating an engine speed signal indicating such speed;

engine cylinder operator means for deactivating and reactivating at each of said cylinders, *such engine cylinder operator means including one or more mechanisms configured to trap gas within deactivated cylinders*;

an electronically controlled throttle valve positioned in the intake manifold of the engine, so as to control the amount of air entering the engine cylinders; and a processor connected with said cylinder operator means and with said throttle valve, with said processor comprising:

means for receiving said pedal position and engine speed signals;

means for selecting the number of cylinders to be operated and for commanding the cylinder operator means to activate the selected number of cylinders, *wherein all engine cylinders are activated responsive to high engine speeds*;

means for selecting an operating position for the throttle valve, based on the values of the engine speed signal as well as upon the value of a transfer function of the accelerator position signal, and upon the number of activated cylinders, such that the changes in the torque output of the engine which accompany changes in the position of the accelerator pedal remain substantially unaltered when the number of activated cylinders changes; and means for selecting the operating gear for a transmission connected with the engine, such that gear speed selection is based at least in part upon the value of the accelerator position signal transfer function.

13. A system for controlling the air entering the intake manifold of a multicylinder variable displacement internal combustion engine installed in a vehicle having a manually controllable accelerator pedal, said system comprising:

a position sensor for determining the operating position of the accelerator pedal and for generating a pedal position signal indicating such position;

an engine speed sensor for determining the speed of the engine and for generating an engine speed signal indicating such speed;

engine cylinder operator means for deactivating and reactivating each of said cylinders, *such engine cylinder operator means including one or more mechanisms configured to trap gas within deactivated cylinders*;

an electronically controlled throttle valve positioned in the intake manifold of the engine, so as to control the amount of air entering the engine cylinders; and a processor connected with said cylinder operator means and with said throttle valve, with said processor comprising:

means for receiving said pedal position and engine speed signals;

means for selecting the number of cylinders to be operated and for commanding the cylinder operator means to activate the selected number of cylinders [and], *wherein all engine cylinders are activated responsive to high engine speeds*;

means for selecting an operating position for the throttle valve, based on the values of pedal position and engine speed signals, as well as upon the number of activated cylinders*; and*

*means for operating a transmission connected with the engine such that a transmission gear is selected by said processor, based at least in part upon the value of the accelerator control position signal.*

*17. The system of claim 1, wherein the processor is configured to operate all cylinders at idle.*

*18. The system of claim 11, wherein the processor is configured to operate all cylinders at idle.*

*19. The system of claim 13, wherein the processor is configured to operate all cylinders at idle.*

*20. A system for controlling the flow of air entering the intake manifold of a multicylinder variable displacement internal combustion engine installed in a vehicle having a manually operable accelerator control, said system comprising:*

*a position sensor for determining the operating position of the accelerator control and for generating an accelerator control position signal indicating such position;*

*an engine speed sensor for determining the speed of the engine and for generating an engine speed signal indicating such speed;*

*engine cylinder operator means for deactivating and reactivating at least some of said cylinders;*

*an electronically controlled throttle valve positioned in the intake manifold of the engine, so as to control the amount of air entering the engine cylinders; and*

*a processor connected with said cylinder operator means and with said throttle valve, with said processor comprising:*

*means for receiving said pedal position and engine speed signals;*

*means for selecting an operating position for the throttle valve, based on the values of the accelerator control position and engine speed signals, as well as upon the effective displacement of the engine; and*

*means for selecting the operating gear for a transmission connected with the engine, such that gear speed selection is based at least in part upon the value of the accelerator position signal.*

*21. A system for controlling the flow of air entering the intake manifold of a multicylinder variable displacement internal combustion engine installed in a vehicle having a manually operable accelerator control, said system comprising:*

*a position sensor for determining the operating position of the accelerator control and for generating an accelerator control position signal indicating such position;*

*an engine speed sensor for determining the speed of the engine and for generating an engine speed signal indicating such speed;*

*engine cylinder operator means for deactivating and reactivating at least some of said cylinders, wherein all engine cylinders are activated responsive to high engine speeds;*

*an electronically controlled throttle valve positioned in the intake manifold of the engine, so as to control the amount of air entering the engine cylinders;*

*a processor connected with said cylinder operator means and with said throttle valve, with said processor comprising:*

*means for receiving said pedal position and engine speed signals;*

*means for selecting an operating position for the throttle valve, based on the values of the accelerator control position and engine speeds, as well as upon the effective displacement of the engine, wherein throttle movement depends upon how aggressively the driver pushes in the pedal; and*

*means for operating a transmission connected with the engine such that a transmission gear is selected by said processor, based at least in part upon the value of the accelerator control position signal.*

* * * * *